US008790161B2

(12) United States Patent
Martin

(10) Patent No.: US 8,790,161 B2
(45) Date of Patent: Jul. 29, 2014

(54) METHOD AND DEVICE FOR TRUING A RAZOR BLADE

(76) Inventor: Jess Martin, Danielsville, GA (US)

( * ) Notice: Subject to any disclaimer, the term of this patent is extended or adjusted under 35 U.S.C. 154(b) by 0 days.

(21) Appl. No.: 12/859,655

(22) Filed: Aug. 19, 2010

(65) Prior Publication Data

US 2011/0203342 A1 Aug. 25, 2011

Related U.S. Application Data

(63) Continuation of application No. 12/360,716, filed on Jan. 27, 2009, now abandoned, which is a continuation of application No. 11/299,315, filed on Dec. 9, 2005, now abandoned.

(60) Provisional application No. 60/634,896, filed on Dec. 10, 2004.

(51) Int. Cl.
*B24B 3/48* (2006.01)

(52) U.S. Cl.
USPC ..... 451/45; 76/82

(58) Field of Classification Search
USPC ..... 451/45, 556, 555, 552, 321; 76/82, 84, 76/88, DIG. 9
See application file for complete search history.

(56) References Cited

U.S. PATENT DOCUMENTS

| | | | | | |
|---|---|---|---|---|---|
| 1,223,127 | A | * | 4/1917 | Walker | 451/552 |
| 1,393,297 | A | * | 10/1921 | McCulley | 451/556 |
| 2,116,582 | A | * | 5/1938 | Muelberger, Jr. | 451/555 |
| 2,674,072 | A | * | 4/1954 | Lohmann | 451/552 |
| 4,779,386 | A | * | 10/1988 | Harris | 451/557 |
| 6,048,262 | A | * | 4/2000 | Ray | 451/555 |

* cited by examiner

*Primary Examiner* — Robert Rose
(74) *Attorney, Agent, or Firm* — Ballard Spahr LLP

(57) ABSTRACT

Truing devices constructed and arranged for truing one or more disposable metallic blades and methods for the manufacture and use of same are disclosed herein.

10 Claims, 10 Drawing Sheets

METHOD AND DEVICE FOR TRUING A RAZOR BLADE

CROSS-REFERENCE TO RELATED APPLICATIONS

This application is a continuation of and claims the benefit of priority to U.S. patent application Ser. No. 12/360,716 filed Jan. 27, 2009 now abandoned, which application is a continuation of and claims the benefit of priority to U.S. patent application Ser. No. 11/299,315 filed Dec. 9, 2005 now abandoned, which application claims the benefit of priority to U.S. Patent Application No. 60/634,896 filed Dec. 10, 2004. The disclosures of these applications are each hereby incorporated by reference in their entirety for all purposes.

FIELD OF THE INVENTION

The present invention relates generally to the field of truing devices and more particularly to truing devices that are constructed and arranged for truing the metallic blade or blades of a disposable razor.

BACKGROUND OF THE INVENTION

Various devices are known in the art to sharpen or maintain the sharpness of a cutting edge. In particular, several devices have been described which purport to influence the cutting blade of a disposable razor in a manner that restores and/or maintains the sharpness thereof and consequently increase the service life of the disposable razor. Examples of such devices include U.S. Pat. Nos. 1,775,518 and 1,782,033 to Forbes, and U.S. Pat. No. 2,321,570 to Billing.

As noted by the prior art, the engagement of a razor's cutting edge to the epidermal surface overtime results in a measured dulling of the blade, which results in increased occurrences of razor burn, chafing and cuts. First, the interaction of the blade with its environment can significantly alter the blades effective service life. To that end, a razor is conventionally stored in a bathroom or bathing area having a primarily hot and humid environment. The blade is thus subjected to a variety of corrosive forces. Secondly, a razor is infrequently cleaned and therefore, often stored within this corrosive environment without removal or rinsing of any residual matter therefrom.

As evidenced by their lack of commercial exploitation, devices in the prior art have proven limited in their scope and effectiveness rendering them largely unacceptable for their stated purpose of increasing the service life of disposable razor blades. This lack of success stems, at least in part, from a difficulty in problem recognition. While it is true that over time a measured dulling of the disposable blade can occur, disposable razor blades are extremely sharp elements that typically develop slight waves in the blade well before a measured dulling of the cutting surface occurs. The waves in the geometry of the razors cutting edge present a feel of dullness to the blade in so far as the blade continues to provide a shave of decreasing closeness and increasing occurrence of razor burn, chafing and cuts.

Thus, while the prior art contemplates various devices to maintain the sharp edge of a disposable razor, it fails to consider the issue of maintaining a true geometrically accurate edge. As such, the need exists for a device that can true the edge of a disposable razor thereby extending the service life of a blade, providing a cost savings to the consumer and reducing the amount of environmental waste.

SUMMARY OF THE INVENTION

The present invention is based, in part, on the discovery of cultured stone materials and compositions suitable for use as in truing disposable razor blades.

In a first aspect, the present invention provides a cultured stone composition comprised of a binder and a resin. The cultured stone composition can further comprise one or more optional additives selected to impart desired properties into the cultured stone product.

In a second aspect, the present invention provides a truing device having a working surface comprised of the cultured stone compositions disclosed and described herein.

In a third aspect, the present invention provides a method for truing a razor blade, such as, for example a disposable razor blade.

In a fourth aspect, the present invention provides a kit for truing razor blades, the kit having a truing device as described and disclosed herein and optionally comprising a packaging material, instructions for use and/or additional marketing materials.

Additional aspects of the invention will be set forth, in part, in the detailed description and Figures which follow, and in part will be derived from the detailed description, or may be learned by practice of the invention. It is to be understood that both the foregoing general description and the following detailed description are exemplary and explanatory only and are not restrictive of the invention as disclosed.

BRIEF DESCRIPTION OF THE FIGURES

The accompanying drawings, which are incorporated in and constitute a part of this specification, illustrate several aspects of the invention and together with the description, serve to explain the principles of the invention.

DETAILED DESCRIPTION OF THE INVENTION

The present invention may be understood more readily by reference to the following detailed description of preferred aspects of the invention and to the Figures and their previous and following description.

Before the present articles, compositions, devices, and/or methods are disclosed and described, it is to be understood that this invention is not limited to the specific articles, devices, and/or methods disclosed unless otherwise specified, as such may, of course, vary. It is also to be understood that the terminology used herein is for the purpose of describing particular aspects only and is not intended to be limiting.

As used herein, the singular forms "a," "an" and "the" include plural referents unless the context clearly dictates otherwise. Thus, for example, reference to "a razor blade" includes aspects having two or more such razor blades unless the context clearly indicates otherwise.

Ranges may be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

Figure 1:
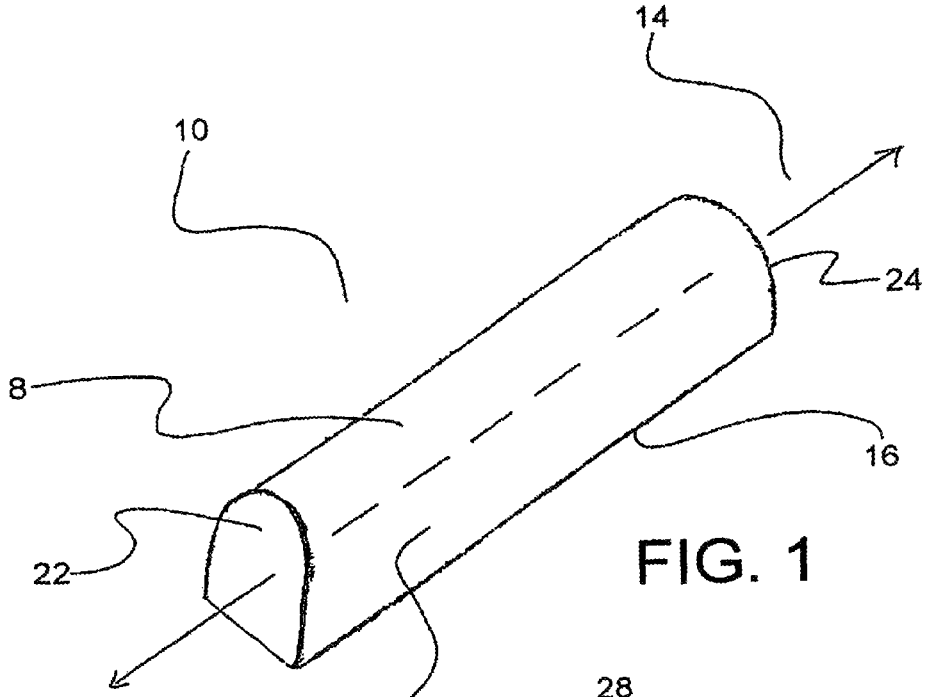
FIG. 1 is a perspective view of an exemplary aspect of a truing device 10 in accordance with the instant invention.
Figure 2:
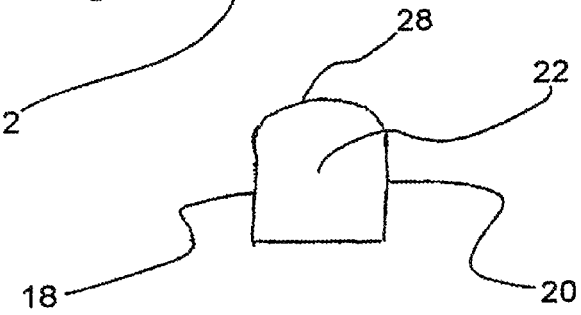
FIG. 2 is an end elevational view of the truing device of FIG. 1.
Figure 3:
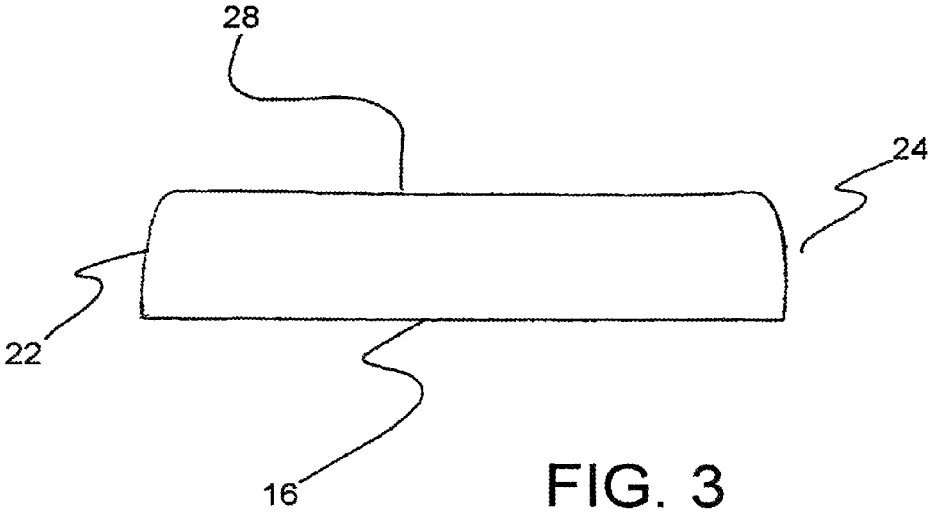
FIG. 3 is a side elevational view of the truing device of FIG. 1.

Referring initially to FIG. 1, an exemplary truing device 10 is illustrated. As depicted, the truing device has an elongated body 12 extending along a longitudinal axis 14 and having a base portion 16. The base portion includes spaced apart side walls 18 and 20, spaced apart end walls 22 and 24, and a substantially planer bottom face 26. The elongated body further comprises a top working surface 28 extending between end walls 22 and 24 that is adapted to engage one or more blades of a desired working piece to be trued.

Figure 4:
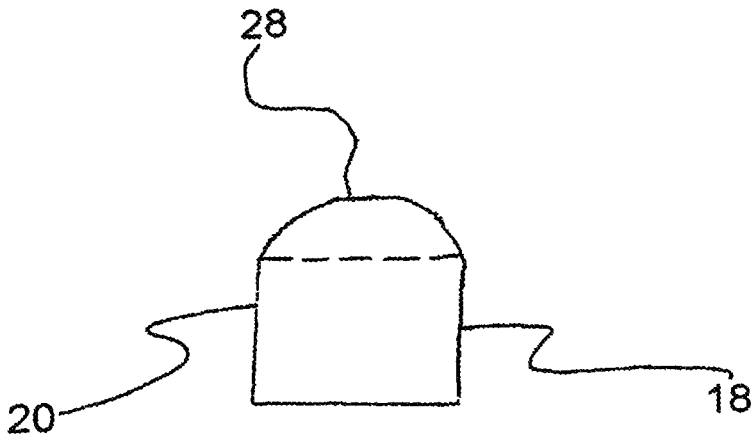
FIG. 4 is an end elevational view of a truing device of the instant invention having a top portion comprised of a working surface and a bottom or base portion comprised of a non-cultured material.
Figure 5:
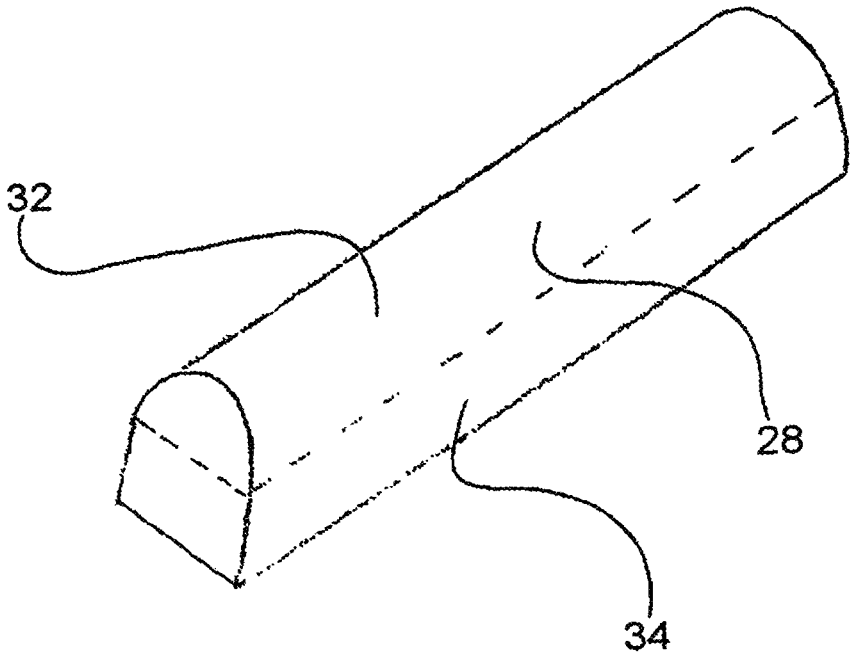
FIG. 5 is a perspective view of the truing device of FIG. 4.

As illustrated in FIG. 1, in one aspect, the top working surface is non planer and slightly arcuate in cross-sectional shape. The arcuately shaped working surface can facilitate the truing of a flexible razor blade designed to contour to the surface to which it is applied. It should, however, also be understood that a truing device according to the instant invention is not limited to a device having an arcuately shaped working surface as a substantially planer cross-sectional working surface can also be used if desired. In still another aspect, the working surface 28 can also form at least a portion of the side walls 18 and 20. In this aspect, and as depicted in FIGS. 4 and 5, the truing device can provide both an arcuate working surface 28 and a substantially planer working surface or surfaces provided by one or both side walls 18 and 20, thus providing a user the choice of working surfaces depending on the blade or blades to be trued.

The working surface 28 is comprised of a synthetic composition having a sufficient rigidity and hardness capable of truing a metallic razor blade, such as a disposable metallic razor blade. More specifically, the synthetic composition of the working surface is comprised of a cultured stone product which, in its broadest sense, is a cured cultured stone precursor composition that comprises a combination of a binder and a thermosetting resin composition.

Commonly referred to in the art as densified marble casting materials, cultured stone products typically comprise materials that, upon densification, pigmentation, mixing and curing, produce a synthetic marble or granite effect. The cultured stone products suitable for use in the instant invention are also inert in water. Accordingly, truing devices and components made with these materials will not swell, crack, be contaminated by, and will not contaminate water which in turn contacts them.

The binder suitable for use in the cultured stone precursor composition is preferably a powdery substance comprised of any known material that suitable for use as a binder or filler component in a cultured stone composition. In one aspect, the binder composition can comprise calcium carbonate ($CaCO_3$). Alternatively, the binder composition can comprises aluminum trihydrate ($Al_2O_3.3H_2O$). In still another aspect the binder composition can comprise a mixture of both Aluminum Trihydrate and Calcium Carbonate.

Liquid colorants, dry pigments, magnetic materials, stabilizers and other additives can be incorporated into the cultured stone precursor composition as desired in order to achieve specifically desired properties such as color, hardness, density and the like. It should be understood that in the preparation of the precursor composition, one or more optional additives can be introduced into the binder composition, the resin composition and/or the cultured stone precursor composition comprised of the binder and resin compositions. Exemplary additives that can be used include any one or more of an additional pigmentation or colorant, additives selected for their ability to impart, for example, a desired color, texture, rigidity, stability, density, porosity and/or realistic stone like effect to the end product. Additionally, magnetic additives can also be introduced in order to provide a magnetized truing device that will have a magnetic attraction to the metallic blade or blades to be trued. Any additive or additive mixture is typically, although not necessarily, blended into the binder composition in an amount in the range of from approximately 0.1 weight percent to approximately 1.0 weight percent based upon the total weight of the binder composition.

Pigments suitable for use as an additive can include inorganic and/or organic pigments. In one aspect, Calcium Carbonate can be used as a pigment in addition to its function as a binder material. Although any desired amount of pigment can be used, typically the added pigment is introduced in an amount in the range of from approximately 0 weight percent to approximately 1 weight percent based upon the total weight of the binder composition, inclusive of such additional amounts and ranges as 0.1, 0.2, 0.3, 0.4, 0.5, 0.6, 0.7, 0.8 and 0.9 weight percent. To that end, a particularly desired pigment and the necessary amount of such pigment for a given application will be readily known or obtained by one of ordinary skill in the art through no more than mere routine experimentation and, as such, the details thereof will not be discussed herein.

Calcium Carbonate can also be introduced as an additive capable of providing a smoother and more even finish to the cured cultured stone composition. To that end, for purposes of texture and finish refinements, calcium carbonate can also be introduced into the binder composition in an additional amount in the range of from approximately 0 weight percent to approximately 0.5 weight percent, inclusive of such additional amounts and ranges as 0.1, 0.2, 0.3, and 0.4 weight percent, based upon the total weight of the binder composition. Additional additives can also be used to impart a desired texture and/or stability to the cured product. For example, in addition to calcium carbonate, the binder composition can further optionally comprise such additives as a valve grinding composition and/or ferric oxide.

The valve grinding composition is capable of reducing friction on the working surface of the truing device and can also facilitate the production of a smooth even finish. Although the valve grinding composition can be used in any desired amount, it typically is introduced into an additive mixture in an amount in the range of from approximately 0 weight percent to approximately 0.01 weight % based upon the total weight of the binder composition, and inclusive of additional amounts as 0.001, 0.002, 0.003, 0.004, 0.005, 0.006, 0.007, 0.008 and 0.009 weight percent. Any conventional and commercially available valve grinding composition can be used in accordance with the instant invention, such as 34B Valve Grinding Compound, available from Permatex, Inc., Hartford, Conn. To this end, in one example, a conventional valve grinding composition can comprise approximately 40 to 50 percent by weight water; approximately 35 to 45 percent by weight silicon carbide; approximately 10 to 20 percent by weight ethylene glycol; approximately 1 to 10 percent by weight castor oil; and approximately 1 to 5 percent by weight carbon black.

The ferric oxide is available from anyone of several commercially known vendors, such as Science Laboratory, in Houston, Tex. The optional ferric oxide additive is capable of enhancing the smooth texture and even finish of the cured cultured stone product. In addition, the ferric oxide can also provide added stability to the cured composition by reducing the occurrence of undesirable chips and cracks that can adversely effect the performance of the working surface of the truing device. To this end, although the ferric oxide can also be used in any desired amount, it typically is mixed with the binder composition in an amount in the range of from approximately 0 weight percent to approximately 1 weight percent based upon the total weight of the binder composition, inclusive of such additional amounts as 0.1, 0.2, 0.3, 0.4, 0.5, 0.6, 0.7, 0.8 and 0.9 weight percent.

In an alternative aspect, magnetic additives can also be introduced into the cultured stone precursor composition in order to provide a cured product that exhibits a magnetic field with a force strong enough to attract the metallic razor blade. This attraction facilitates the contact of the blade with the working surface of the truing device. Such materials can include iron, nickel, and cobalt, and all those alloys that contain any proportion of these metals. The magnetized materials can also be permanently magnetized by a strong magnetic field. For example, steel and special alloys such as Alcomax, Alnico, and Ticonal, which contain various amounts of aluminum, nickel, cobalt, and copper, can be used to make permanent magnets or magnetized material suitable for use in the precursor composition.

The thermosetting resins useful for preparation of the cultured stone precursor composition can include any commercially available resin known for use in the manufacture of cultured stone products. For example, unsaturated polyesters, acrylic-modified polyesters and acrylics are particularly well suited resins for use in the instant precursor composition. In a preferred aspect, the resin is an unsaturated polyester in styrene monomer, such as Armor Cast CMSM-2440 available from Cook Composites and Polymers, Co. North Kansas City, Mo.

The resin composition can also be combined with one or more optional additives such as liquid colorants, dry pigments, magnetic materials, stabilizers and the like in order to achieve specifically desired properties such as color, magnetism, hardness, density, finish and texture. One preferred additive for use with a resin is a sodium silicate solution. To this end, sodium silicate can help to promote a smooth surface and can reduce the undesired porosity of the finished cultured stone. Although sodium silicate and other additives can be added in any desired and optimum amount, in one aspect it is preferred that such additives be introduced into the precursor composition in an amount in the range of from approximately 0.01 to approximately 1.0 weight percent based upon the total weight of the resin composition; including such additional amounts as 0.05, 0.1, 0.15, 0.20, 0.25, 0.30, 0.35, 0.40, 0.45, 0.50, 0.55, 0.60, 0.65, 0.70, 0.75, 0.80, 0.85, 0.90 and 0.95 weight percent.

In order to prepare the cultured stone precursor composition, the binder composition, including any optional additives admixed therein, is combined with the thermosetting resin composition and blended by any suitable means to provide a substantially homogenous precursor composition. To that end, the cultured stone precursor composition preferably comprises an amount of binder composition that is in the range of from approximately 40 to approximately 80 weight percent based upon the total weight of the cultured stone precursor composition, including such weight percentages as approximately 45, 50, 55, 60, 65, 70 and 75 and including such ranges as approximately 35 to 75 weight percent, approximately 40 to approximately 70, and approximately 45 to approximately 65 weight percent. In contrast, the thermosetting resin preferably is present in the range of from approximately 20 to approximately 60 weight percent based upon the total weight of the cultured stone precursor composition, including such amounts as 25, 30, 35, 40, 45, 50 and 55 weight percent and including such ranged as approximately 25 to approximately 55, approximately 30 to approximately 50, and approximately 35 to approximately 45.

Prior to curing, a catalyst suitable for maintaining clarity and colorlessness in the finished casting, is introduced into the precursor mixture in an amount in the range of about 0.1 to about 5.0% by volume relative to the volume of the cultured stone precursor composition. Any catalyst suitable for use in initiating the cross linking reaction of the thermosetting resin composition and in turn the curing of the precursor composition can be used, including for example those catalyst products manufacture and made commercially available from Composite One, Atlanta, Ga.

Figure 7:
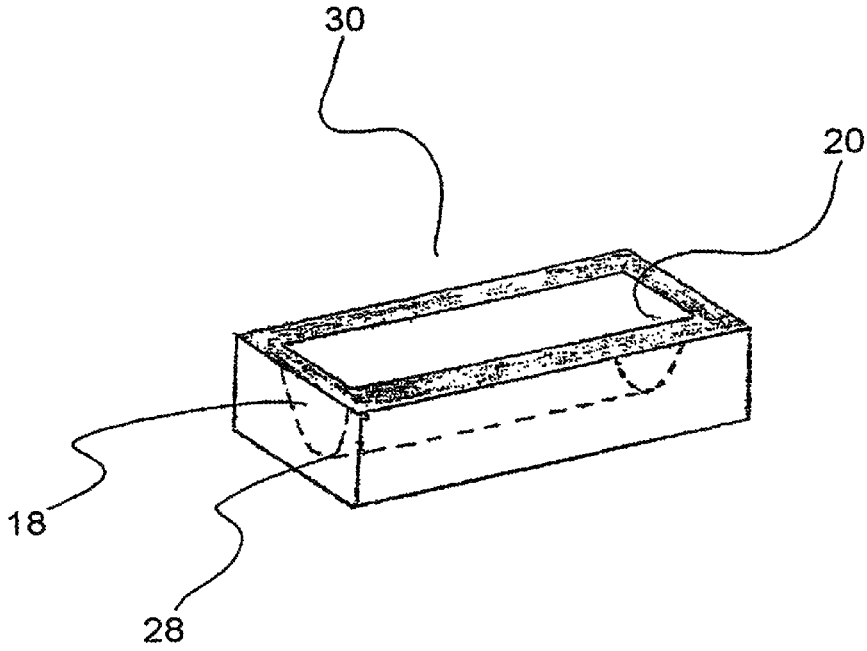
FIG. 7 is a perspective view of an exemplary mold used to prepare the cultured stone truing device of FIG. 1.

Once the catalyst has been introduced into the cultured stone precursor composition, the resulting precursor and catalyst combination can then be charged into a suitable mold apparatus for curing. For example, as depicted in FIG. 7, the precursor composition can be charged into a mold 30 having any desired shape and size. As further depicted in FIG. 7, the mold can provide a cast having an arcuate working surface as described above. Further, portions of the end walls 18 and 20 of the mold can be arcuate in shape, or angled, with respect to the top surface of the device. Thus, in exemplary aspects, the cast can have end walls that are angled and/or arcuately shaped. This facilitates the removal of the cured cast from the mold when the curing reaction has completed.

The cultured stone precursor compositions described herein can be cured at room temperature as a result of the catalyst initiating the cross linking reaction with the thermosetting resin. Depending on the conditions of the surrounding environment, typically the curing reaction will take approximately 1 to 2 hours to complete. Additionally, it should be appreciated that in order to speed up the curing reaction, a mold charged with the cultured stone precursor composition can also be cured at elevated temperatures above room or ambient in order to speed the curing time. As such it is further contemplated that when placed in a heated oven, the curing time can be reduced to as low as approximately 30 minutes. Persons skilled in the art will therefore appreciate that any known means for increasing the curing rate can be employed, including for example, infra-red, radiant, heated mold, conductive and/or convective heat processes.

It should be understood that, in one aspect, the entire truing device is comprised of the cultured stone product as described above. Accordingly, a mold constructed and arranged to provide a desired elongated body 12 as depicted in FIG. 1 would be charged with the cultured stone precursor composition. Once cured, the resulting cast product is a solid unitary structure comprised entirely of the cultured stone product. However, as depicted in FIG. 5, in another aspect of the instant invention, the truing device can be comprised only partially of the cultured stone product. For example, a truing device can be comprised of a top portion 32 having working surface 28 bonded to a base portion 34. In this aspect, the top portion is a cast manufactured from a desired mold constructed and arranged to provide the desired size and shape of the top portion and working surface 28. Additionally, the top portion is then bonded or otherwise affixed to the base portion that is constructed of any suitable material capable of supporting the working surface during use. Suitable base portion materials can include, without limitation, such materials as plastics, wood, ceramics, glass and the like.

In still another aspect, it can be desired for the truing device to contain magnetic material that can attract the metallic blade or blades to be trued. This can facilitate the contact between the working surface of the truing device and the blade to be trued. In one aspect, and as mentioned above, a magnetized material, such as magnetize powder or other particulate materials can be incorporated into the cultured stone precursor composition prior to curing. Such exemplary materials can include, without limitation, iron, nickel, cobalt, and any alloy that contains at least a proportion of one or more of these metals. Steel and special magnetic alloys such as Alcomax, Alnico, and Ticonal, which contain various amounts of aluminum, nickel, cobalt, and copper, are also suitable for use as a magnetic material. Further, ceramics, made under high pressure and at high temperature from powders of various metal oxides can also serve as a suitable magnetic material.

Figure 6:
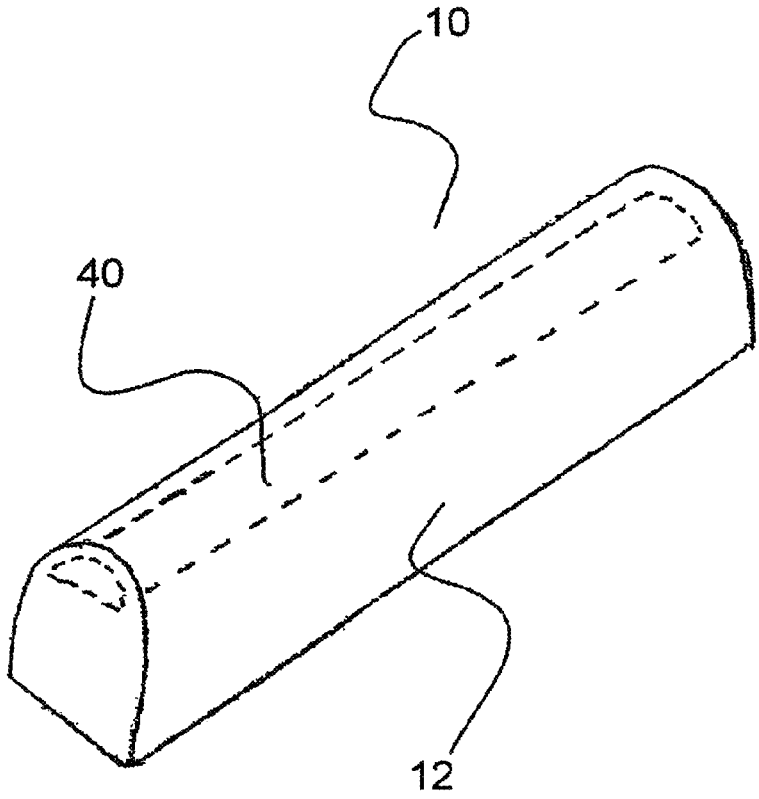
FIG. 6 is a perspective view of an alternative aspect of a truing device showing a magnetic material embedded below a working surface of the truing device.

In still another aspect, and as illustrated in FIG. 6, a magnetic device 40 such as a magnetic strip, rod or other elongated device can be deposited just below the exterior top surface of the working surface. According to this aspect, rather than doping the cultured stone precursor composition with a magnetized additive, the magnetic device would be positioned beneath the surface at a predetermined depth prior to final curing of the composition. To that end, the submerged magnetic device should have a magnetic field strong enough to permeate through to the surface of the cured cultured stone product such that it can still influence and provide a magnetic attraction with the metallic blade or blades to be trued.

Figure 8:
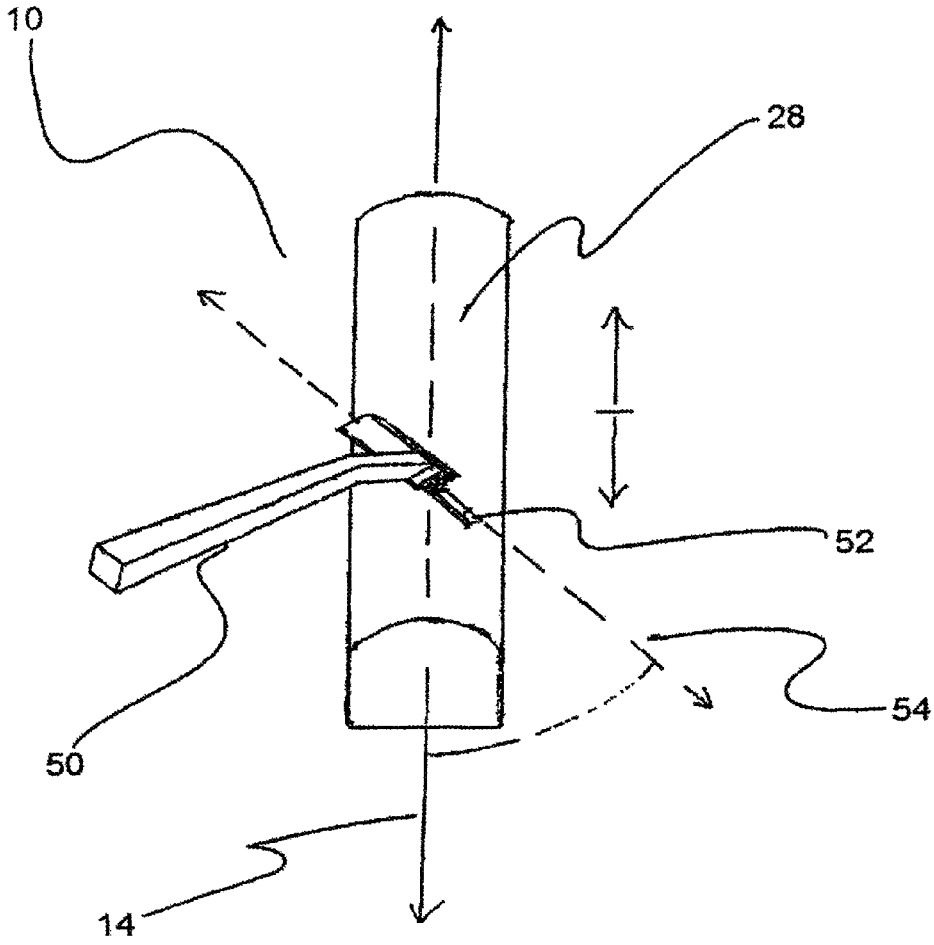
FIG. 8 is an end perspective view of the truing device of FIG. 1 in use.

In use, and as depicted in FIG. 8, a razor 50 having a metallic razor blade 52 integrated therein is positioned on the working surface 28 of the truing device 10. The longitudinal axis 54 of the blade is positioned at an acute angle (such as for example approximately 30-45 degrees) relative to the longitudinal axis 14 of the truing device. The user then applies sufficient pressure to the razor 50 such that the blade 52 deforms and at least substantially contours to the shape of the working surface so the entire surface or at least the substantially entire cutting edge of the blade is in contact with the working surface of the truing edge. Using a motion similar to that of shaving, the razor should then be drawn along the longitudinal axis of the truing device in a repeated manner until a desired result is achieved. In an aspect employing a sufficiently soft cultured stone material, it is possible that a minuscule layer of the culture stone material may be removed or sliced off of the working surface during the truing process. However, it should be understood that this removal of material will not damage the disposable blade nor does it result in the inoperability of the truing device.

Figure 9:
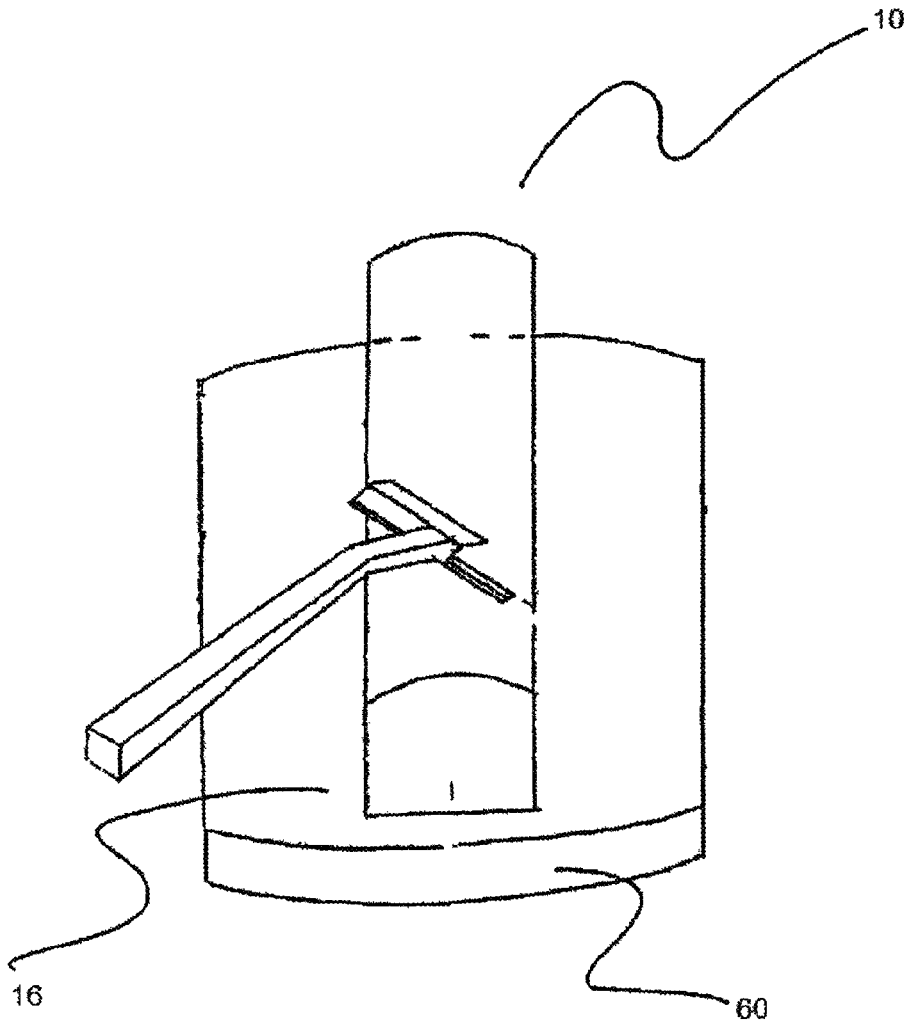
FIG. 9 is an end perspective view of a truing device wherein the base portion further comprises a flange member extending from all four sides.
Figure 10:
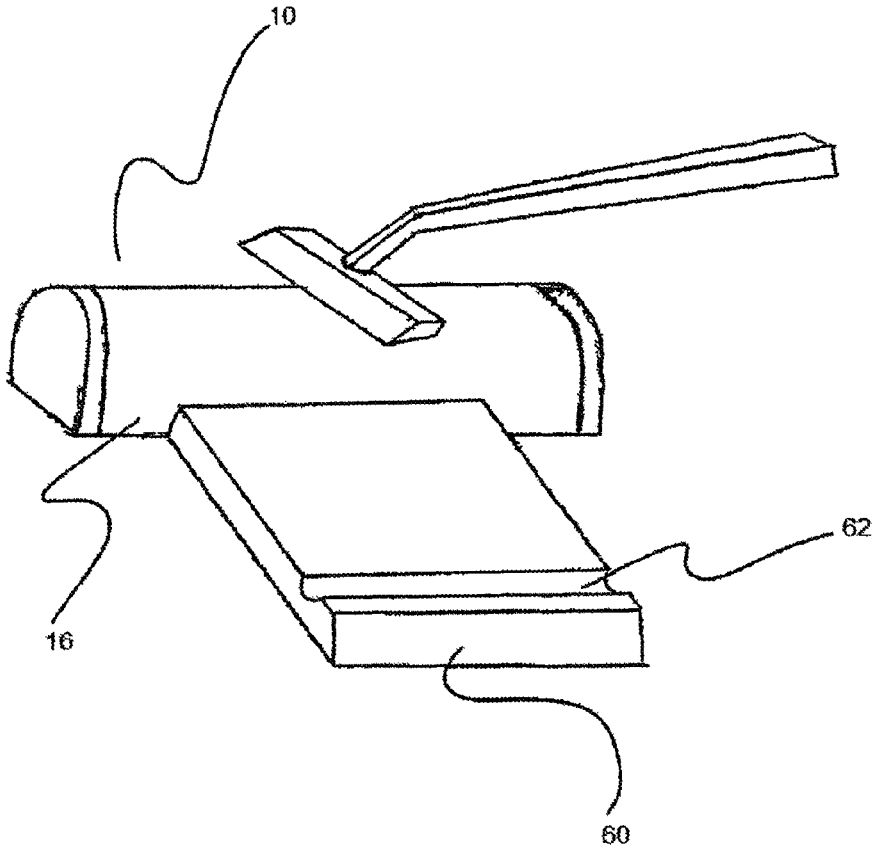
FIG. 10 is a side perspective view of a truing device wherein the base portion further comprises a flange member extending from one side of the truing device and wherein the flange member further comprises a trough constructed and arrange to receive a razor blade.
Figure 11:
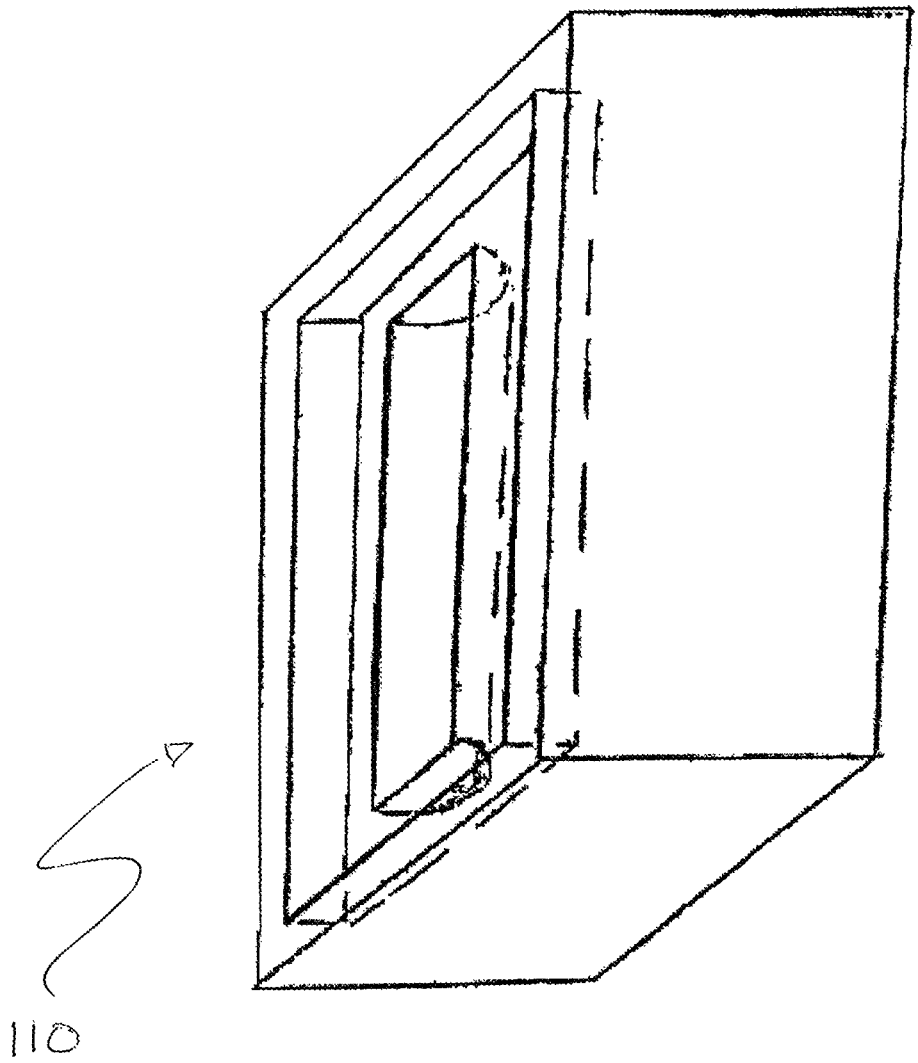
FIG. 11 is a perspective view of an exemplary mold 110 used to prepare the truing device of FIG. 9.
Figure 12:
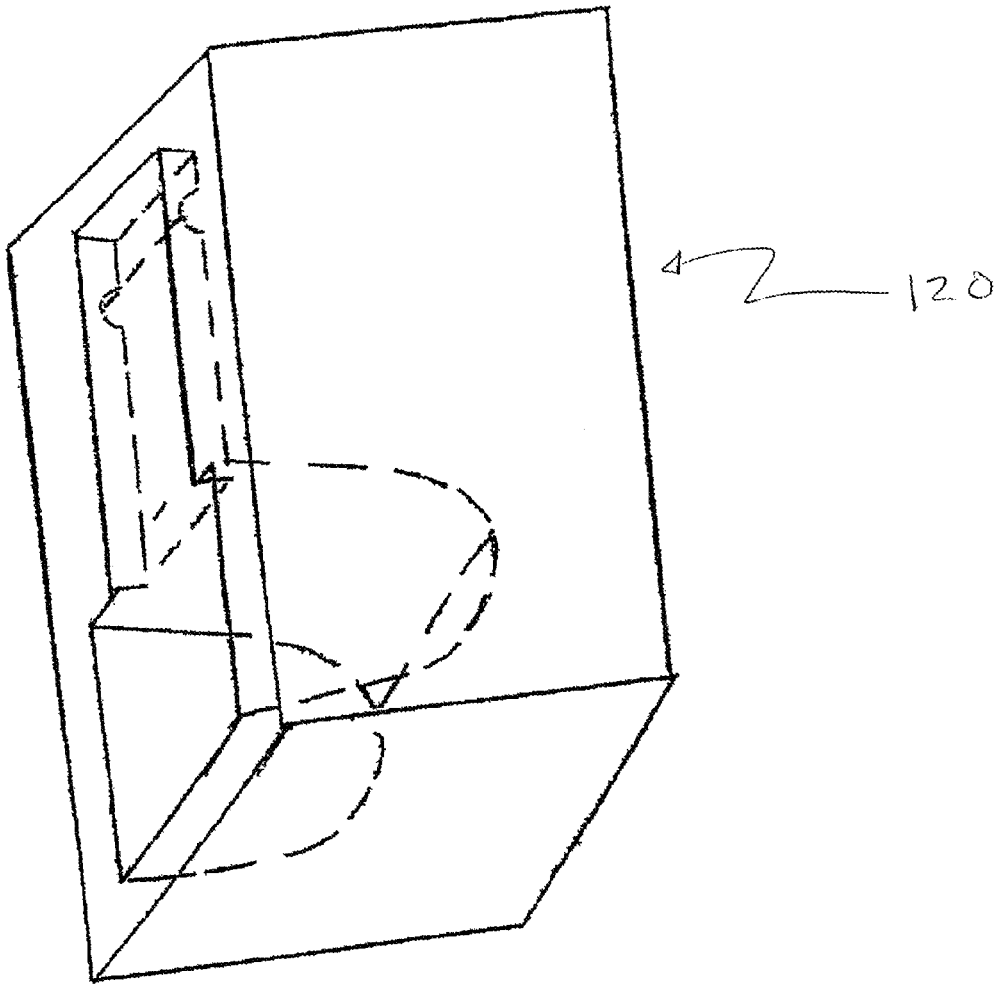
FIG. 12 is a perspective view of an exemplary mold 120 used to prepare the truing device of FIG. 10.

In still another aspect, and as depicted in FIGS. 9 and 10, the base portion 16 of the truing device can further comprise a flange member 60, extending outwardly from one or more side walls and or end walls of the truing device. For example, as shown in FIG. 9, the flange member 60 extends outwardly relative to all four sides of the truing device. Alternatively, and as shown in FIG. 10, the flange member 60 can extend outwardly relative to one side of the truing device.

It will be appreciated upon practice and use of the instant invention that the flange member 60 can be constructed and arranged to provide added functionality to the truing device. In one aspect, the flange member 60 can provide added stability to the truing device when in use. For example, the truing device can rest on a countertop and remain sufficiently stable during use that a user will not need to grasp or otherwise secure the device during use. Additionally, as depicted in FIG. 10, the flange member 60 can further comprise a trough 62, constructed and arranged to receive the blade portion of a razor. According to this aspect, the flange member 60 and trough 62 provide the use with the option of storing the razor on the truing device when not in use. Further, it should also be understood that the base portion of the truing device can comprise a means for securing or releasably securing the truing device to a counter top, shelf, shower wall, bathroom wall and the like.

The truing device described herein can be used in connection with any conventional disposable razor blade known in the art. For example, a truing device as described herein can be used to true single or multiple blades. Further, as is common in the state of the art, more and more manufacturers are providing multiple blade razor cartridges and are thus incorporating spacers and multiple blade protection wires. As such, it is further contemplated that the truing device of the instant invention can too be used to true disposable razors constructed with these recent advances without inflicting damage to the spacers and protection wires.

In still another aspect, the present invention provides a method for the manufacture of a truing device as described herein. Accordingly, the method comprises providing a cultured stone precursor composition such as that described in detail above. The precursor composition, containing the requisite base resin and binder components and any desired additives, i.e., pigments, colorants, stabilizers, magnetic materials and the like, is then blended with a catalyst to initiate the curing reaction. Once the catalyst has been blended into the composition, the resulting mixture is charged into a mold having a desired shape and size. The shape and size of the truing device is not critical and can be scaled to any desired parameter, so long as the finished device is of a size and shape suitable for truing a particular blade or plurality of blades.

Once the cultured stone precursor and catalyst composition has been charged into the mold, the composition is then allowed to cure for a time sufficient to provide a cultured stone material having a desired hardness. Typically, the cultured stone precursor compositions of the instant invention will cure at ambient temperature and pressure in approximately 1 to 2 hours. However, it should be appreciated that in order to speed up the curing reaction, a mold charged with the cultured stone precursor composition can also be cured at elevated temperatures above room or ambient in order to speed the curing time. As such it is further contemplated that when placed in a heated oven, the curing time can be reduced to as low as approximately 30 minutes. Persons skilled in the art will therefore appreciate that the method of the instant invention can further comprise heat curing the cultured stone precursor composition by any known means such as infrared, radiant, heated mold, conductive and/or convective heat processes.

In still another aspect, the present invention provides a kit for truing a disposable razor blade. An exemplary kit can include a truing device as discussed herein and a suitable packing material. Additionally, the kit can optionally contain instructions for use and/or additional marketing materials or literature. To that end, instructions optionally included within a kit of the instant invention would be in substantial accordance with the method for truing a disposable razor blade discussed herein. Moreover, marketing literature can be provided as a pamphlet contained within the packaging or can be provided on the packaging itself such that a potential buyer of the kit can read the literature prior to purchasing the kit. It is contemplated that such added literature can for example contain religious content.

EXPERIMENTAL

The following examples and experimental data are put forth so as to provide those of ordinary skill in the art with a complete disclosure and description of how the cultured stone composition and a truing device comprised of same can be made, used and/or evaluated. These examples are intended to be purely exemplary of the invention and are not intended to limit the scope of what is encompassed within the spirit and scope of the invention. Efforts have been made to ensure accuracy with respect to numbers (e.g., amounts, temperature, etc.) However, some errors and deviations should be accounted for. Unless indicated otherwise, parts are parts by weight, temperature is in ° C. or is at ambient temperature, and pressure is at or near atmospheric.

Example 1

Prophetic Preparation of a Culture Stone Precursor Composition

An exemplary cultured stone precursor composition for use in the preparation of a cultured stone truing device according to the instant invention would be prepared by admixing the following components in the specified amounts to achieve a substantially homogenous composition or mixture.

First, a binder and additive mixture would be prepared by mixing the following components in the stated relative weight percentages of Table 1 below:

TABLE 1

| Component | Weight Percent |
|---|---|
| Binder (Granite Elite ®, obtained from Composite One, Atlanta, Georgia). | 99.56 wt % |
| $CaCO_3$ binder additive (Composite One, Atlanta, Georgia) | 0.32 wt % |
| Valve Grinding Composition | 0.005 wt. % |
| Ferric Oxide (Composite One, Atlanta, Georgia) | 0.0535 wt % |
| $CaCO_3$ Pigment (Composite One, Atlanta) | 0.0535 wt % |

The resulting binder and additive mixture would then be blended with a thermosetting resin composition. An exemplary resin composition would be prepared by blending the following components in the stated relative weight percentages of Table 2 below:

TABLE 2

| Component | Weight Percentage |
|---|---|
| Unsaturated polyester in monomer resin (CMCM-2414, obtained from Composite One, Atlanta Georgia) | 99.65 wt. % |
| Sodium Silicate | 0.35 wt. % |

The final cultured stone precursor composition would then be prepared by blending approximately 65 weight percent of the final binder composition of Table 1 with approximately 35 weight percent of the final resin composition of Table 2.

Example 2

Prophetic Manufacture of Truing Device of the Instant Invention

A predetermined amount of the cultured stone precursor composition that could be prepared according to Example 1 can then be mixed a catalyst (Catalyst, available from Composite One, Atlanta, Ga.) in an amount of approximately 1.25 weight percent based on the weight of precursor composition used from Example 1. This resulting mixture of Binder, Resin and Catalyst can then be charge into a desired mold, such as that depicted in FIG. 7. The catalyst will initiate the cross linking reaction of the resin and in turn will result in the curing of the precursor composition. In the absence of means for heat curing the composition, the curing process will take approximately 1.5 hours to complete. The resulting cultured stone casting can then be removed from the mold and will be ready for packaging and/or use.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein.

What is claimed is:

1. A truing device for a disposable razor blade, comprising:

a) an elongated base portion extending along a longitudinal axis and having opposed first and second side walls, opposed first and second end walls, and a substantially planer bottom face; and b) a smooth top working surface portion extending between the opposed first and second end walls and configured to engage at least a portion of a disposable razor blade, wherein the smooth top working surface portion is comprised of a synthetic hard surface material comprised of a cured precursor composition, the precursor composition comprising a calcium carbonate component, a thermosetting polyester resin component, and an additive component comprising at least one additive selected from a liquid colorant, dry pigment, magnetic material, and stabilizer;

wherein in use the smooth top working surface of the device is capable of truing an edge of a disposable razor blade; and wherein in use the smooth top working surface of the device is not capable of restoring sharpness of an edge of a disposable razor blade.

2. The truing device of claim 1, wherein the top working surface portion comprises a non-planar cross sectional shape.

3. The truing device of claim 2, wherein the top working surface portion comprises an arcuate cross sectional shape.

4. The truing device of claim 1, wherein the base portion further comprises the synthetic hard surface material.

5. The truing device of claim 4, wherein the truing device is a cast of a mold.

6. The truing device of claim 1, wherein the elongated base portion further comprises a flange member extending outwardly from at least one opposed side wall, at least one opposed end wall, or a combination thereof.

7. The truing device of claim 6, wherein the flange member further comprises a bottom face that is co-planar with the substantially planar bottom face portion of the elongated body member.

8. The truing device of claim 6, wherein the flange member further comprises a top face portion, wherein at least a portion of the top face portion forms a trough configured to receive at least a portion of a disposable razor blade.

9. A method for truing a disposable razor blade, comprising the steps of:

a) providing the truing device comprising:

an elongated base portion extending along a longitudinal axis and having opposed first and second side walls, opposed first and second end walls, and a substantially planer bottom face; and a smooth top working surface portion extending between the opposed first and second end walls, wherein the smooth top working surface portion is comprised of a synthetic cultured stone material and is configured to engage at least a portion of a disposable razor blade;

wherein the synthetic cultured stone material is comprised of a cured precursor composition, the precursor composition comprising a calcium carbonate component, a thermosetting polyester resin component, and an additive component comprising at least one additive selected from a liquid colorant, dry pigment, magnetic material, and stabilizer;

b) applying a disposable razor blade having a longitudinal axis on to a portion of the working surface of the truing device such that the longitudinal axis of the razor blade forms an acute angle relative to the longitudinal axis of the truing device base portion;

c) applying pressure to the razor blade so that at least a portion of the razor blade conforms to the contour of the working surface; and d) drawing the conformed razor blade of step c) along at least a portion of the working surface and in a direction along the longitudinal axis of the elongated base portion;

wherein the method is not capable of restoring sharpness to an edge of the disposable razor blade.

10. The truing device of claim 1, wherein the cured precursor composition comprises calcium carbonate; a valve grinding composition; ferric oxide; sodium silicate; and an unsaturated polyester.

* * * * *